US009709355B2

(12) United States Patent
Joplin et al.

(10) Patent No.: US 9,709,355 B2
(45) Date of Patent: Jul. 18, 2017

(54) RECOIL COMPENSATOR FOR FIREARM

(71) Applicant: Jered S. Joplin, Jefferson, GA (US)

(72) Inventors: Jered S. Joplin, Jefferson, GA (US); Jeffrey J. Harris, Jefferson, GA (US)

( * ) Notice: Subject to any disclaimer, the term of this patent is extended or adjusted under 35 U.S.C. 154(b) by 22 days.

(21) Appl. No.: 14/571,220

(22) Filed: Dec. 15, 2014

(65) Prior Publication Data

US 2016/0169606 A1 Jun. 16, 2016

(51) Int. Cl.
*F41A 21/36* (2006.01)

(52) U.S. Cl.
CPC ..... *F41A 21/36* (2013.01)

(58) Field of Classification Search
CPC ..... F41A 21/30–21/42
USPC ..... 42/1.06; 89/14.1–14.4; 181/223
See application file for complete search history.

(56) References Cited

U.S. PATENT DOCUMENTS 1,994,458 A * 3/1935 Barnes ..... F41A 21/36 89/14.3
2,124,075 A * 7/1938 Moore ..... F41A 21/325 89/14.1
2,192,081 A * 2/1940 Hughes ..... F41A 21/36 89/14.3
2,417,721 A * 3/1947 Whedon ..... F41A 21/40 42/79
2,484,988 A * 10/1949 Finlay ..... F41A 21/40 42/79
2,656,637 A * 10/1953 Richards ..... F41A 21/42 42/79
2,685,144 A * 8/1954 Schroeder ..... F41A 21/42 42/79
2,712,193 A * 7/1955 Mathis ..... F41A 21/42 42/79
2,796,005 A * 6/1957 Shapel ..... F41A 21/36 89/14.3
3,971,285 A * 7/1976 Ellis ..... F41A 35/06 89/14.3
5,020,416 A * 6/1991 Tripp ..... F41A 21/38 89/14.3
5,092,223 A * 3/1992 Hudson ..... F41A 21/38 89/14.2
5,279,200 A 1/1994 Rose
5,698,810 A * 12/1997 Rose ..... F41C 27/22 42/97
6,276,251 B1 * 8/2001 Downing ..... F41A 21/36 89/14.3
6,412,389 B2 * 7/2002 Fluhr ..... F41A 21/30 181/223

(Continued)

*Primary Examiner* — Stephen M Johnson
*Assistant Examiner* — Benjamin Gomberg
(74) *Attorney, Agent, or Firm* — R. Tracy Crump

(57) ABSTRACT

The recoil compensator uses a two piece design that allows for convenient indexing of the vent channels relative to the barrel, while securely mounting the compensator to the threaded end of a barrel. The recoil compensator consists of a muzzle brake and a jam nut. The muzzle brake turns onto the threaded end of the barrel and the jam nut is operatively threaded onto the body of the muzzle brake so that it can be tightened about the muzzle brake and the barrel to securely lock the muzzle brake to the barrel once properly indexed relative to the barrel. The jam nut has an annular flange that overlies the body of the muzzle brake to provide a clean aesthetic appearance of the recoil compensator.

3 Claims, 5 Drawing Sheets

(56) References Cited

U.S. PATENT DOCUMENTS

| | | | | |
|---|---|---|---|---|
| 8,250,962 | B1 * | 8/2012 | Guenther | F41A 21/28<br>42/107 |
| 8,820,473 | B1 * | 9/2014 | White | F41A 21/34<br>181/223 |
| 2012/0152649 | A1 * | 6/2012 | Larue | F41A 21/30<br>181/223 |

* cited by examiner

RECOIL COMPENSATOR FOR FIREARM

This invention relates to firearms and in particular, a recoil compensator mountable to the barrel of a firearm.

BACKGROUND AND SUMMARY OF THE INVENTION

Muzzle brakes or recoil compensators ("compensators") are devices connected to the muzzle of a firearm that redirect propellant gases to counter recoil and muzzle rise during operation. Compensators have been used in various forms on rifles, pistols and revolvers. Generally, compensators use a variety of slots, vents, holes, baffles to redirect and control the burst of combustion gasses that follows the departure of a projectile to affect the movement of the firearm under recoil. Compensators can be as simple as a diagonal cut in the barrel itself. Often compensators are separate attachment parts affixed to the threaded end of the firearm barrel. Compensators that are separate attachment parts must be affixed to the barrel to properly orient or index the slots, vents and holes with respect to the barrel in order to have the desire recoil affect. Heretofore, mounting and indexing a recoil compensator involved the use of a selective number of crush washers to accommodate the desired spacing between the barrel and the compensator so that the compensator was properly indexed relative to the barrel.

The recoil compensator of this invention uses a two piece design that allows for convenient indexing of the vent channels relative to the barrel, while securely mounting the compensator to the threaded end of a barrel. The recoil compensator consists of a muzzle brake and a jam nut. The muzzle brake turns onto the threaded end of the barrel and the jam nut is operatively threaded onto the body of the muzzle brake so that it can be tightened about the muzzle brake and the barrel to securely lock the muzzle brake to the barrel once properly indexed relative to the barrel. The jam nut has an annular flange that overlies the body of the muzzle brake to provide a clean aesthetic appearance of the recoil compensator. The two piece design also allows the compensator to be conveniently fitted to the barrel and eliminates the need for fitting a muzzle brake using multiple crush washers.

The above described features and advantages, as well as others, will become more readily apparent to those of ordinary skill in the art by reference to the following detailed description and accompanying drawings.

BRIEF DESCRIPTION OF THE DRAWINGS

The present invention may take form in various system and method components and arrangement of system and method components. The drawings are only for purposes of illustrating exemplary embodiments and are not to be construed as limiting the invention. The drawings illustrate the present invention, in which.

DESCRIPTION OF THE PREFERRED EMBODIMENTS

Figure 1:
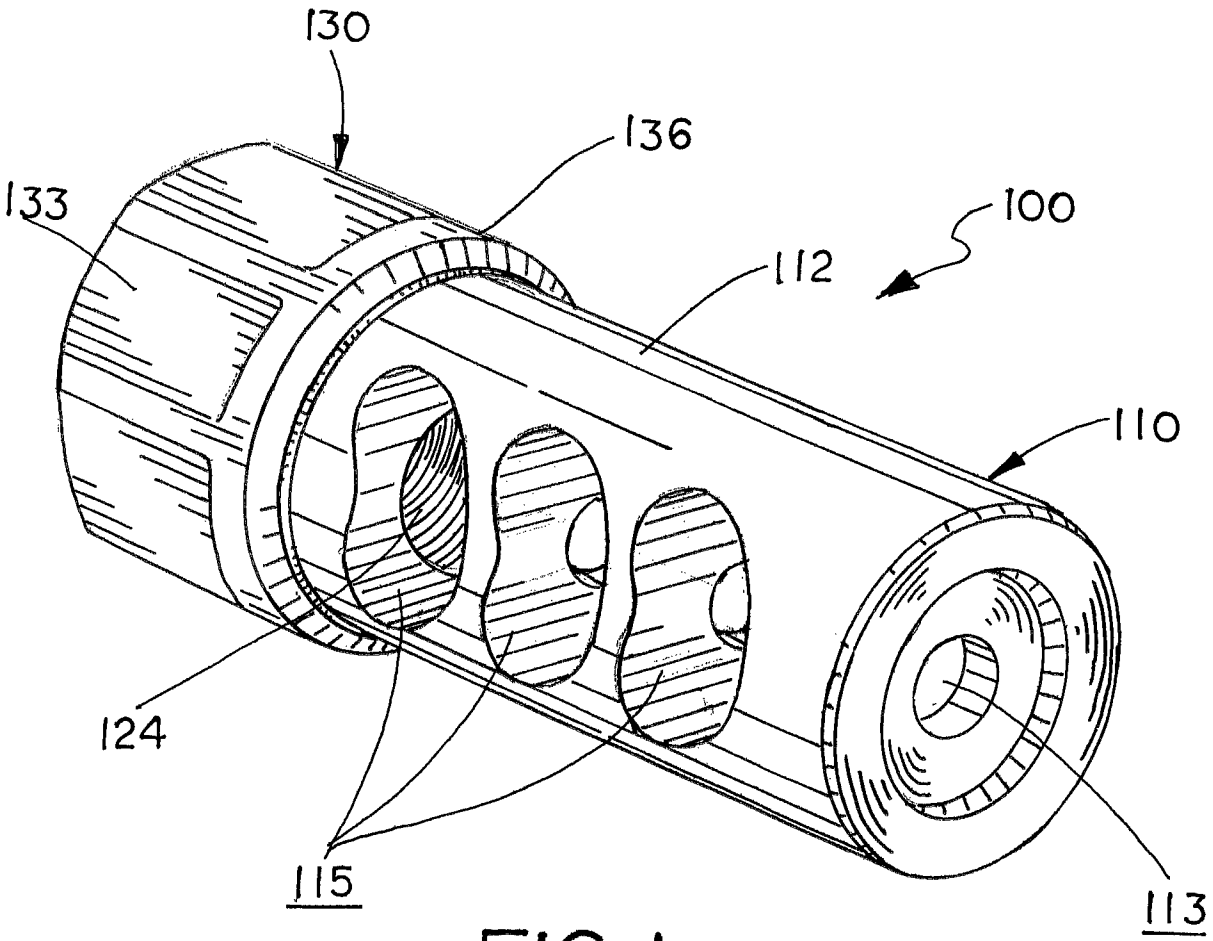
FIG. 1 is a perspective view of an exemplary embodiment of the recoil compensator of this invention.
Figure 2:
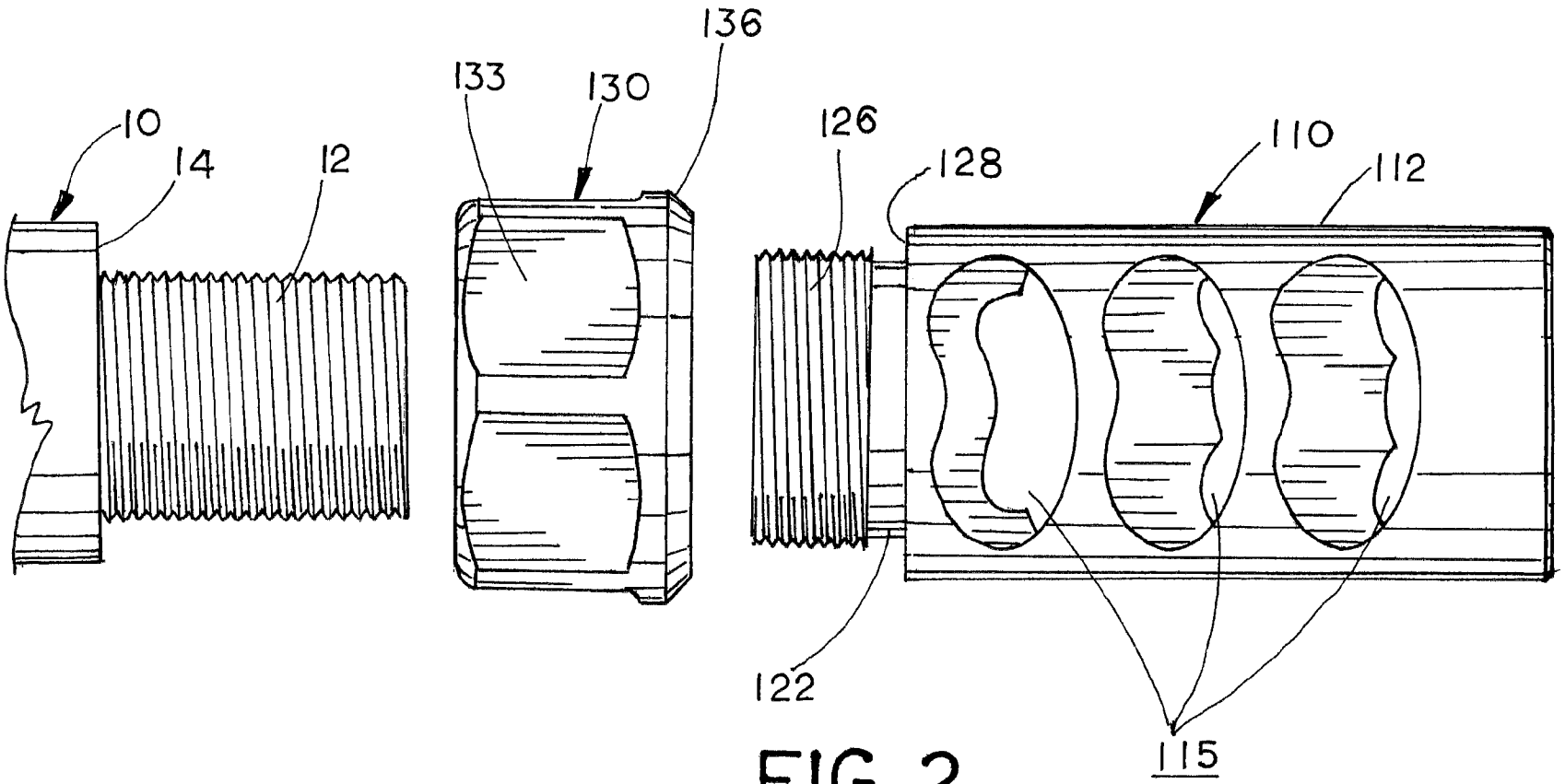
FIG. 2 is a side exploded view of the compensator of FIG. 1.
Figure 3:
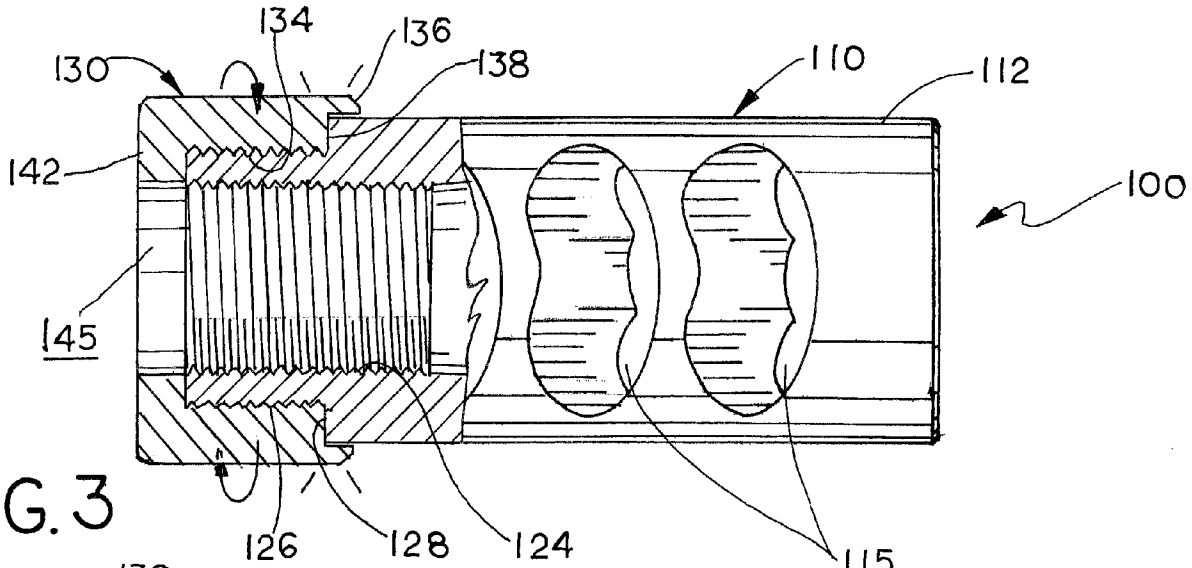
FIG. 3 is a partial side sectional view of the compensator of FIG. 1.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical, structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense, and the scope of the present invention is defined only by the appended claims.

Referring now to the drawings, FIGS. 1-6 illustrate an exemplary embodiment of the recoil compensator of this invention, which is designated generally as reference numeral 100. Compensator 100 is designed and intended to reduce muzzle rise by laterally venting combustion gases as rounds are discharge through the barrel of a firearm. Compensator 100 is intended to be adapted to the muzzle end of any conventional firearm barrel, including but not limited to rifles, pistols, revolvers and the like. In addition, compensator 100 may be adapted to accommodate any weapon caliber within the teachings of this invention. For simplicity of illustration and explanation, compensator 100 is depicted in the drawings mounted to the threaded end 12 on a conventional center fired rifle barrel 10.

Recoil compensator 100 consists of two separate parts: a muzzle brake 110 and a jam nut 130. Both muzzle brake 110 and jam nut 130 are typically machined, cast or otherwise fabricated and constructed from separate blocks of metal, such as steel, aluminum or titanium. Muzzle brake 110 turns onto threaded end 12 of barrel 10. Jam nut 130 operatively threaded onto the body of muzzle brake 110 and is tightened onto the muzzle brake and barrel to securely lock the muzzle brake to the barrel when properly indexed relative to the barrel.

As shown, muzzle brake 110 has a cylindrical body 112 and an integral tubular neck 122. As shown, brake body 112 is machined to have an axial through bore 113 and a plurality of vent channels 115 (three openings are shown). Bore 113 is axially aligned with the bore of barrel 10 when muzzle brake 100 is mounted to the barrel 10 and is dimensioned to accommodate the particular caliber of the firearm. Vent channels 115 are angled and contoured openings cut or machined in body 112 that allow combustion gas to vent laterally from muzzle brake 100. The configurations of vent channels 115 are specifically selected to affect the recoil impulse of the weapon, as well as the aesthetic appearance of compensator 100. Brake neck 122 is a tubular wall extending axially from the barrel end of brake body 112. Brake neck 122 has an inner threaded section 124 cut or formed on its interior wall and an outer thread section 126 cut or formed on its exterior wall. Inner threaded section 124 is configured to turn onto threaded end 12 of barrel 10. Brake neck 122 is inset slightly from the end of brake body 112 forming an annular outer shoulder 128.

Jam nut 130 has a tubular sidewall 133 and an end wall 142. An inner threaded section 134 is cut or formed on the interior of sidewalls 133, which is configured to turn onto exterior threaded section 126 of brake neck 120. The outer face of sidewall 133 has hexagonal facets, which allow jam nut 130 to be tightened to barrel 10 using a wrench or other suitable tools. An annular flange 136 extends outward from the open end of sidewall 133, which forms an annular inner shoulder 138. End wall 142 has a central threaded bore 145 therethrough, which is configured to receive threaded end 12 of barrel 10. Threaded bore 145 also matches inner threaded section 124 of muzzle brake 110.

Muzzle brake 110 and jam nut 130 are each configured and dimensioned with respect to barrel 10 so that a) collectively the length of inner threaded section 124 of muzzle brake 110 and the length (and also the width of end wall 134) of threaded bore 135 is less than the length of the threaded end 12 of barrel 10; b) the length of outer threaded section 126 of muzzle brake 110 is approximately equal to the length of inner threaded section 136 of locking lug 130; and c) the inner diameter of flange 140 is slightly greater than the outer diameter of brake body 112.

Figure 4:
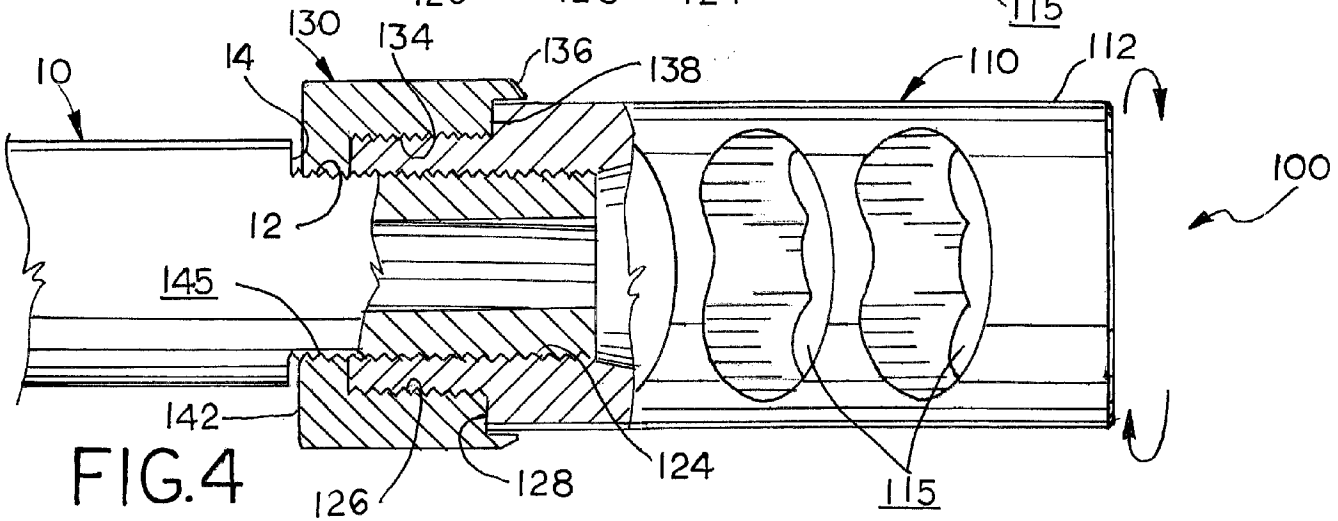
FIG. 4 is a partial side sectional view of the compensator of FIG. 1 being mounted to a firearm barrel showing the compensator being initially turned onto a threaded barrel end.
Figure 5:
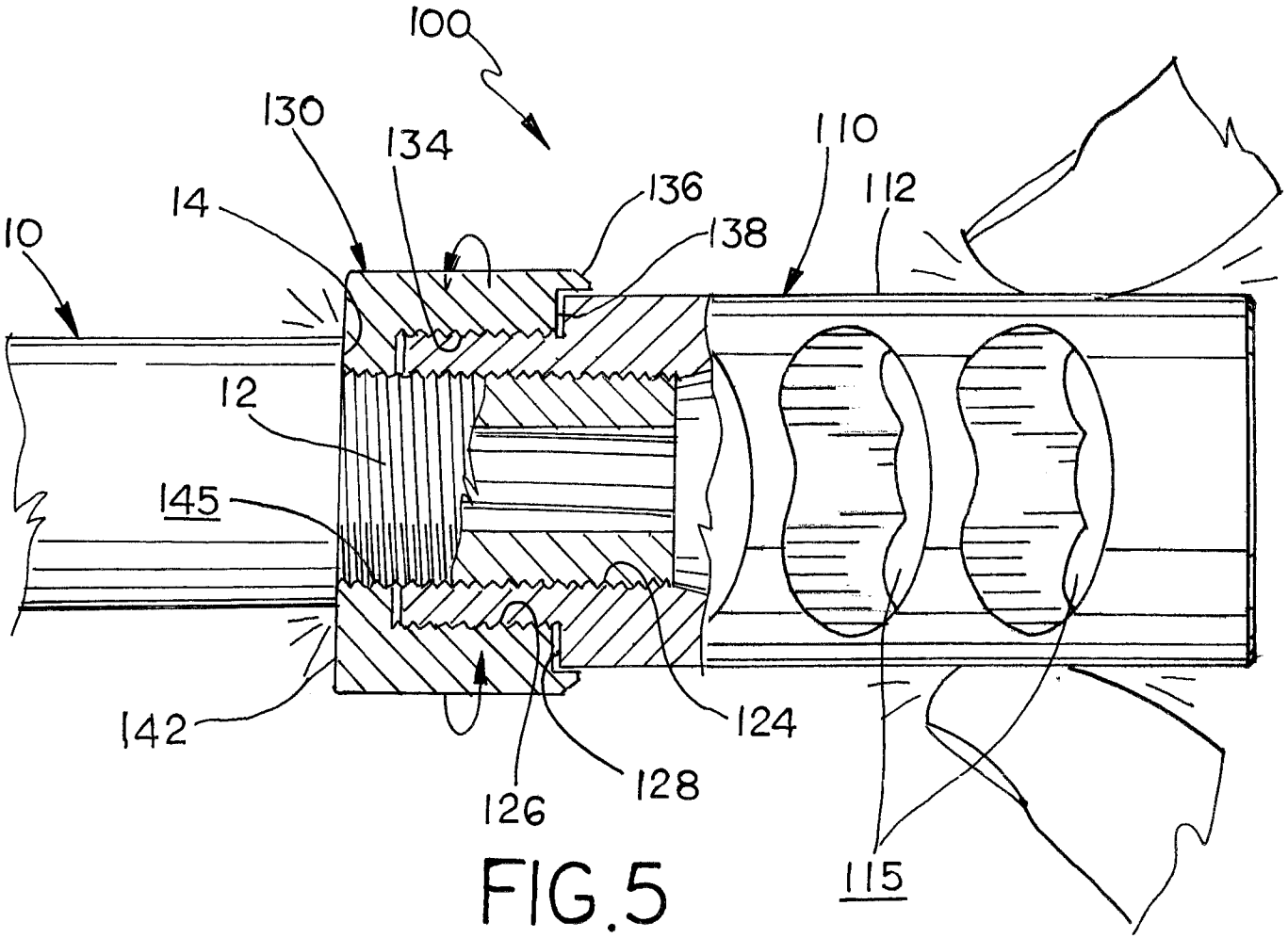
FIG. 5 is another partial side sectional view of the compensator of FIG. 1 being mounted to a firearm barrel showing the jam nut being initially turned onto the muzzle brake.
Figure 6:
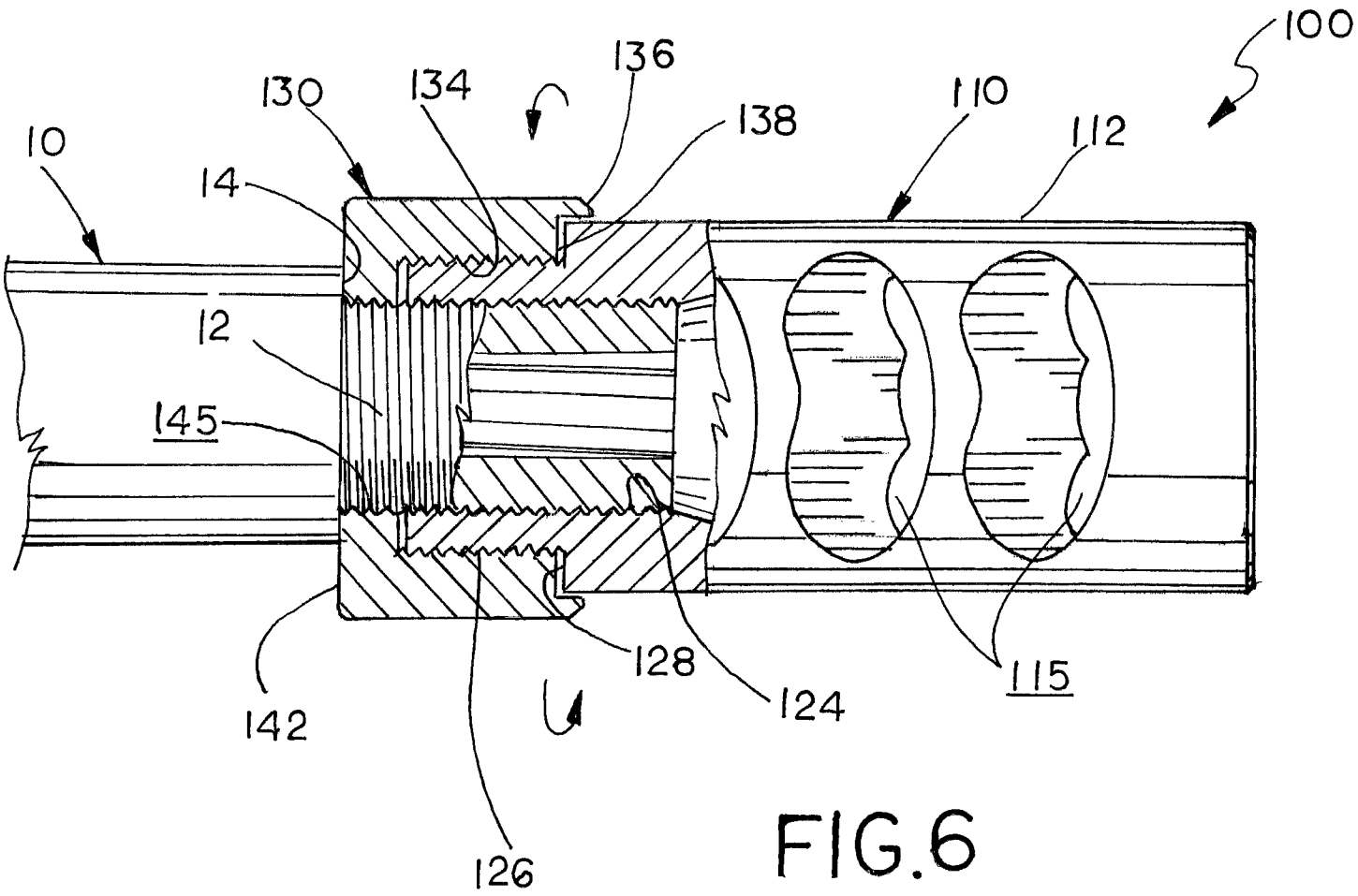
FIG. 6 is a partial side sectional view of the compensator of FIG. 1 being mounted to a firearm barrel showing the jam nut being tightened against the barrel to secure the muzzle brake in position relative to the barrel.

FIGS. 3-6 illustrate how compensator 100 is fitted to barrel 10. Before compensator 100 is fitted to barrel 10, jam nut 130 is initially turned onto muzzle brake 110 so that shoulders 128 and 138 abut (FIG. 3) and flange 136 extends partially over muzzle body 112. Next, muzzle brake 110 and jam nut 130 are turned onto threaded end 12 of barrel 100 until the threaded end of barrel 10 extends through threaded bore 145 and is completely turned into threaded section 124 of muzzle brake 110. Once fully turned onto threaded end 12, muzzle brake 110 is then turned back a partial revolution to properly index muzzle brake 110 relative to barrel 100 with vent channels 115 positioned equal laterally to the vertical plane of the barrel bore (FIG. 4). One skilled in the art will note that once properly indexed, a small gap is presented between the end wall of jam nut 130 and annular shoulder 14 of barrel 10. Next, jam nut 130 is rotated to extend from brake neck 122 and contact barrel shoulder 14, while muzzle brake 110 is manually held fast (FIG. 5). Once contacting barrel shoulder 14, jam nut 130 is tightened down using a wrench or other suitable tool to lock muzzle brake 110 in position (FIG. 6).

One skilled in the art will note that the two piece design of the recoil compensator allows for convenient indexing of the vent channels relative to the barrel, while securely mounting the compensator to the threaded end of a barrel. The two piece design also allows the compensator to be conveniently fitted to the barrel and eliminates the need for fitting a muzzle brake using multiple crush washers. The jam nut is operatively threaded onto the body of the muzzle brake so that it can be tightened about the muzzle brake and the barrel to securely lock the muzzle brake to the barrel once properly indexed relative to the barrel. The jam nut also has an annular flange that overlies the body of the muzzle brake to provide a clean aesthetic appears of the recoil compensator.

It should be apparent from the foregoing that an invention having significant advantages has been provided. While the invention is shown in only a few of its forms, it is not just limited but is susceptible to various changes and modifications without departing from the spirit thereof. The embodiment of the present invention herein described and illustrated is not intended to be exhaustive or to limit the invention to the precise form disclosed. It is presented to explain the invention so that others skilled in the art might utilize its teachings. The embodiment of the present invention may be modified within the scope of the following claims.

We claim:

1. A recoil compensator for a firearm barrel having a threaded barrel end and an annular barrel shoulder adjacent the threaded barrel end, the compensator comprising:

a muzzle brake adapted to mount to the threaded barrel end; and a jam nut adapted to mount to the threaded barrel end and operatively connected to the muzzle brake, the muzzle brake includes a cylindrical brake body and a tubular brake neck extending axially from the brake body, the brake neck having an outer threaded section and an inner threaded section configured to turn onto the threaded barrel end, the jam nut includes a tubular nut sidewall and a nut end wall, the nut end wall having a central axial threaded bore configured to turn onto the threaded barrel end, the nut sidewall having an inner threaded section turned onto the outer threaded section of the brake neck so that the jam nut can be manually rotated to traverse over the brake neck and the threaded barrel end when mounted to the barrel between a first position where the nut sidewall abuts the brake body and a second position where the nut sidewall is spaced from the brake body forming a gap therebetween and the nut end wall abuts the barrel shoulder such that the jam nut selectively locks the muzzle brake in position relative to the barrel, the nut side wall also has an annular flange extending axially therefrom, the flange configured to partially overlie the brake body and to enclose the gap between the brake body and the jam nut when the jam nut is in the second position.

2. The compensator of claim 1 wherein the nut side wall has a plurality of flat exterior facets.

3. The compensator of claim 1 wherein the muzzle brake has a plurality of lateral vents defined therein.

* * * * *